United States Patent [19]

Giguere

[11] Patent Number: 4,674,246

[45] Date of Patent: Jun. 23, 1987

[54] SEALED DOUBLE GLAZING SLIDING WINDOW CONSTRUCTION

[75] Inventor: Jean-Paul Giguere, St-Agapit, Canada

[73] Assignee: Donat Flamand Inc., Quebec, Canada

[21] Appl. No.: 802,611

[22] Filed: Nov. 25, 1985

Related U.S. Application Data

[63] Continuation of Ser. No. 480,305, Mar. 30, 1983, abandoned.

[30] Foreign Application Priority Data

Feb. 7, 1983 [CA] Canada ..... 421059

[51] Int. Cl.[4] ..... E05D 15/06; E06B 1/04; E06B 3/34

[52] U.S. Cl. ..... 52/207; 49/404; 49/419; 49/431; 49/458

[58] Field of Search ..... 52/207, 208, 204, 211, 52/213; 49/504, 404, 453, 454, 458, 431, 432, 433, 419

[56] References Cited

U.S. PATENT DOCUMENTS

| | | | |
|---|---|---|---|
| 1,691,868 | 11/1928 | Dawson | 49/454 |
| 2,627,092 | 2/1953 | Grossman | 52/207 |
| 2,804,954 | 9/1957 | Gillespie | 52/588 |
| 3,320,700 | 5/1967 | Bohn | 49/404 |
| 3,383,801 | 5/1968 | Dallaire | 49/458 |
| 3,745,706 | 7/1973 | Stermar | 49/404 |
| 4,034,510 | 7/1977 | Huelschopf | 49/454 |
| 4,158,934 | 6/1979 | Olsen | 49/458 |
| 4,238,907 | 12/1980 | Swan | 49/404 |
| 4,257,202 | 3/1981 | Biro | 52/204 |
| 4,265,052 | 5/1981 | Johnson et al. | 49/504 |
| 4,327,524 | 5/1982 | van der Laan | 49/453 |
| 4,333,283 | 6/1982 | Ebata | 49/504 |
| 4,398,373 | 8/1983 | Mancuso | 52/207 |
| 4,554,770 | 11/1985 | Anders | 52/207 |
| 4,558,536 | 12/1985 | Dunsmoor | 49/504 |

FOREIGN PATENT DOCUMENTS

| | | | |
|---|---|---|---|
| 1358331 | 3/1964 | France | 52/207 |
| 6605002 | 10/1967 | Netherlands | 49/404 |
| 368599 | 5/1963 | Switzerland | 52/207 |
| 2150188 | 6/1985 | United Kingdom | 52/204 |

*Primary Examiner*—William F. Pate, III
*Assistant Examiner*—Michael Safavi
*Attorney, Agent, or Firm*—Larson and Taylor

[57] ABSTRACT

A sliding window having two or more removable sashes each having a sash frame supporting a sealed doubled glazing unit, the sash frame having a sash head and a sash sill made from a thermally insulating plastic material extrusion presenting a hollow structure with two spaced apart guiding legs adapted to engage into and slide along corresponding head track and sill track members. The head track and sill track members provide a pair of guide grooves for the slidable sash and a pair of guide grooves of the same spacing for the fixed sash. A runner or a plurality of runners of appropriate anti-friction material may be disposed between the guiding legs of the sash sill and they bear upon a horizontal bearing surface provided on the sill track between the guide grooves of the corresponding pair thereof. The runners prevent contact between the guiding legs of the sash sill and the bottom of the guide grooves of the sill track. This anti-friction system is particularly useful in the case of relatively heavy slidable sashes. In addition, a waterproofing cover is provided over the uncovered portion of the outer pair of guide grooves of the sill track, providing a main sloping surface extending outwardly and downwardly for draining excess water and thus better waterproofing this critical region of the sliding window.

17 Claims, 4 Drawing Figures

SEALED DOUBLE GLAZING SLIDING WINDOW CONSTRUCTION

This application is a continuation of application Ser. No. 480,305, filed Mar. 30, 1983, now abandoned.

BACKGROUND OF THE INVENTION

This invention relates to the construction of sliding windows for domestic use, and more particularly it relates to sliding windows using sealed double glazing elements and the main object of this invention is to provide improved waterproofing and superior thermal insulation.

Considering the ever increasing cost of energy for household heating, it is more and more important to increase the degree of weather-proofing of windows used in housing projects particularly in relatively cold climates where it is normal to use storm windows or double windows. In prior sliding windows, double glazing is obtained by means of pairs of single glazed sashes, generally one pair being fixed and the other being slidable although in some cases all four sashes are slidable. This system is known to provide a limited degree of protection against air infiltration, and therefore the resultant thermal efficiency of such known windows is necessarily limited.

SUMMARY OF THE INVENTION

A primary object of the present invention is to provide a sliding window construction using sealed multiple glazing elements capable of meeting new more demanding requirements in such matters as weatherproofing and thermal insulation. I have discovered that by using sashes whose frame comprises pairs of guiding legs for the sash head and for the sash sill, and a pair of spaced apart guiding projection on the sash jamb with a lateral extension to support one such extension, it is possible to considerably improve the thermal efficiency of sliding windows particularly when the sash frame of each sash is made from extruded members made of thermally insulating plastic material, more particularly, hollow extrusions.

When using a sash frame with a predetermined spacing between its guiding legs, corresponding to the distance between the sashes of a conventional single glazed double windows, it becomes possible to greatly increase the thermal efficiency of such a preexisting sliding window by simply replacing the old single glazed sashes with a sealed double glazed sash according to this invention, if not with such a sash but having a sealed triple glazing unit, should such be deemed necessary.

In accordance with a feature of this invention I also provide runners made of appropriate anti-friction material disposed between the guiding legs of the sash sill of the slidable sash and the sill track supporting same so as to avoid all contact between the guiding legs and the bottom of the guide grooves of the sill track receiving them. By using appropriate material, for example an anti-friction plastic such as that sold under the trade mark TEFLON, in association with a sill track made of polyvinyl chloride, one obtains a sliding window which presents a very low degree of resistance to displacement of the slidable sash without any losses from the point of view of waterproofing and thermal resistance.

Finally, I propose to use a waterproofing cover having a main sloping surface disposed immediately outside the sash sill of the sash frame of the slidable sash, and covering the exposed portion of the guide grooves of the sill track receiving the fixed sash. This means allows perfect waterproofing of the window in the critical area of the lower edge of the slidable sash when same in the fully closed position.

BRIEF DESCRIPTION OF THE DRAWINGS

In the attached drawings which illustrate a preferred exemplary embodiment of the invention.

DETAILED DESCRIPTION OF THE PREFERRED EMBODIMENT

Figure 1:
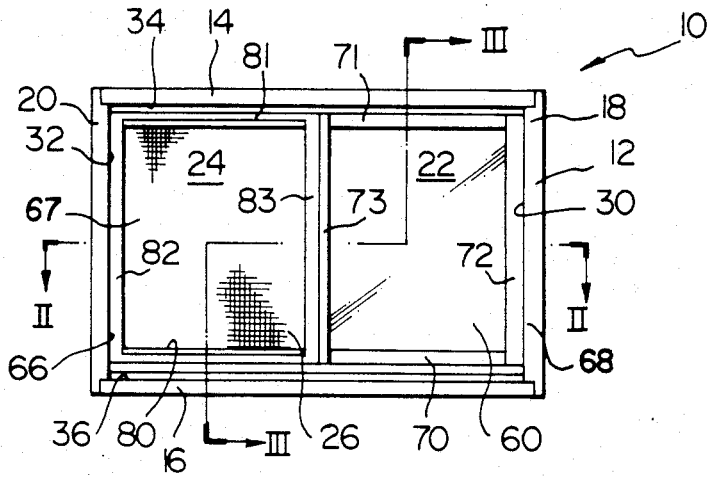
FIG. 1 is an elevational view of a sliding window.

In FIG. 1 of the drawings, the sliding window 10 comprises a frame 12 having a head 14, a sill 16, a right jamb 18 and a left jamb 20, a fixed sash 22 and a movable sash 24 in front of which appears a screen 26.

Figure 2:
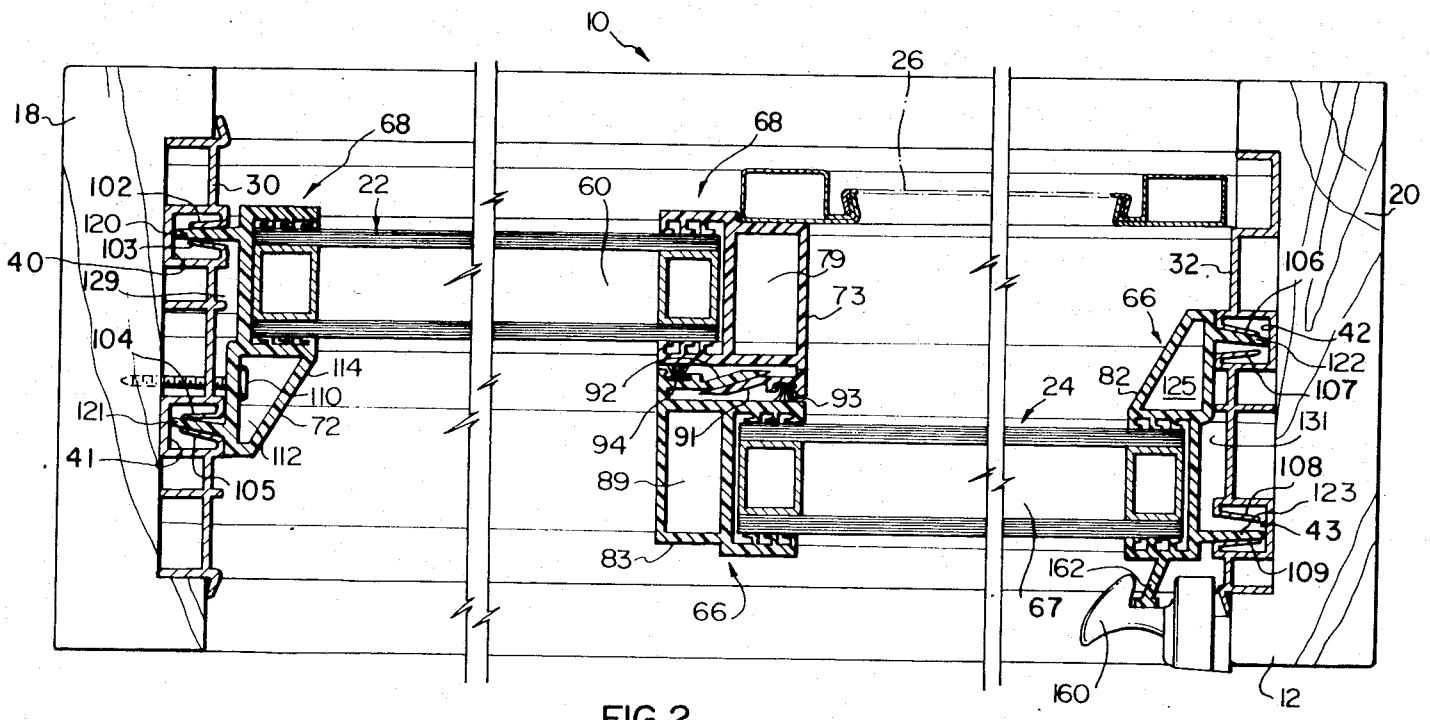
FIG. 2 is an upside down cross-sectional view of the window of FIG. 1 taken along line II—II.

Frame 12 is made of treated wood and it is usually covered with a vinyl cladding at least on the side thereof exposed to weather, that is to say the side which is apparent in FIG. 1. On each jamb 18 and 20 there is provided a vertical track 30 and 32 as shown in FIG. 2 of the drawings whereas on head 14 and sill 16 head track 34 and sill track 36 respectively are mounted as better shown in FIG. 3 of the drawings.

Figure 3:
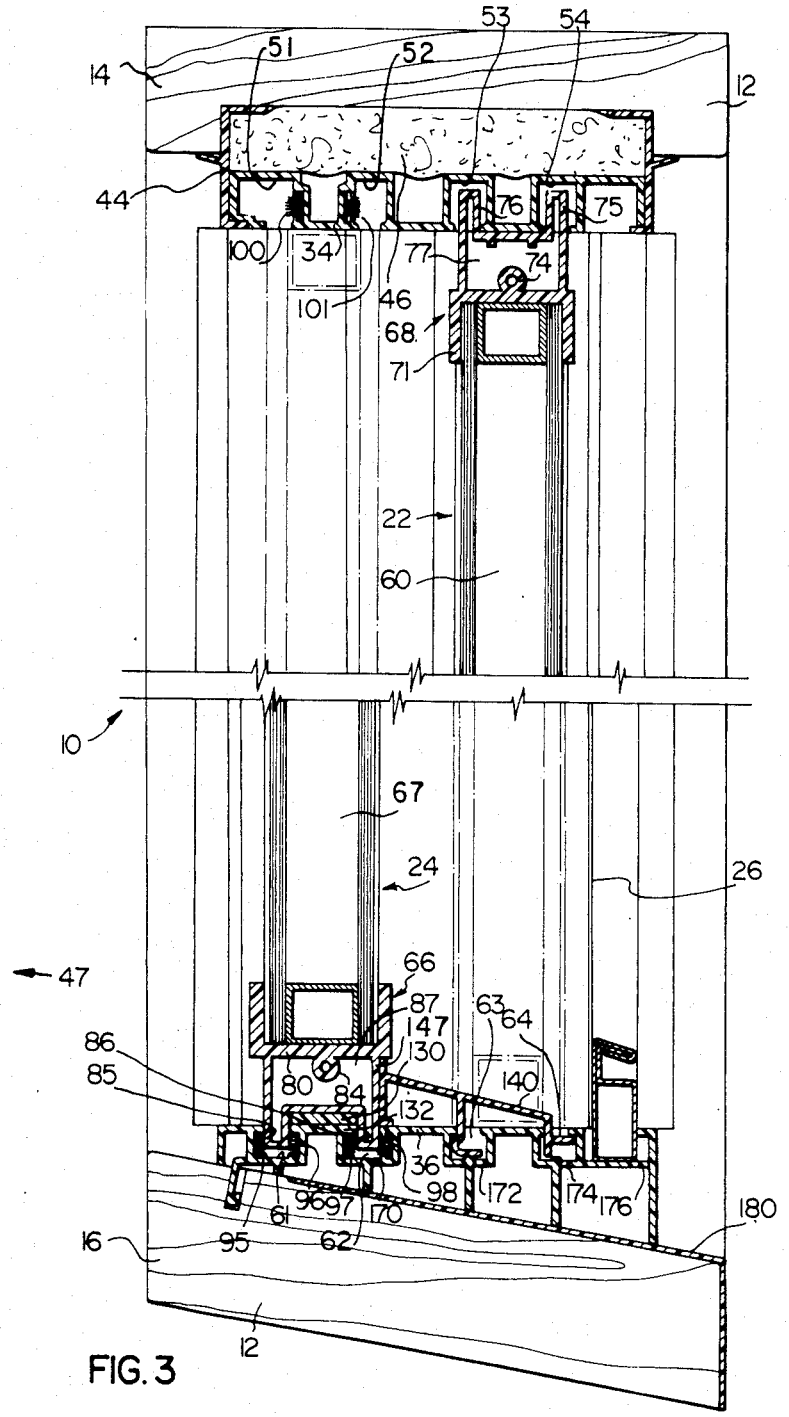
FIG. 3 is a vertical cross-sectional view taken along line III—III of FIG. 1.

Tracks 30, 32, 34 and 36 are made by an extrusion process from a suitable plastic material, normally polyvinyl chloride and they are secured to frame 12 by means of staples (not shown). The type of tracks 30, 32, 34 and 36 shown in FIGS. 2 and 3 is essentially conventional, and usually these tracks are used to receive double windows consisting of two single glazing fixed sashes and two single glazing slidable sashes. Accordingly, a vertical track 30 comprises two spaced apart receiving grooves 40 and 41 while vertical track 32 of left jamb 20 has two spaced apart receiving grooves 42 and 43. Receiving grooves 40 and 41 normally receive the exterior edge of conventional single glazed slidable sashes (not shown) whereas receiving grooves 42 and 43 receive the opposite edge of single glazed sashes (not shown) as is found in sliding windows of conventional design.

According to the present invention, the two sashes 24 and 22 have sealed double glazing elements and are removable, and at least one of them is slidable. In the embodiment illustrated in the drawings, the movable sash is seen at reference numeral 24. In order to permit removal of sashes 24 and 22, the head track 34 is supported in a box-type structure 44 secured to head 14 and comprising a sufficient volume of insulating, compressible fiber 46. Thus, when slidable sash 24 is located toward the middle of frame 12, a simple upward pressure applied on both sides of sash 24 allows upward bending of head track 34 and this frees the lower edge of slidable sash 24 which therefore can be removed from inside the building, that is to say in the direction of arrow 47 (see FIG. 3). In a similar fashion, one can also thereafter remove toward the inside of the building the lower edge of fixed sash 22 provided the retaining means as will be noted hereinafter have been removed.

Head track 34 of head 14 comprises a first pair of guide grooves 51 and 52 adapted to guide the upper edge of slidable sash 24, and a second pair of guide grooves 53 and 54 receives the fixed sash 22. Similarly, sill track 36 of sill 16 comprises a first pair of guiding grooves 61 and 62 for slidable sash 24 and a second pair of guiding grooves 63 and 64 for fixed sash 22. The distance between the guiding grooves in any pair is the same in all cases because, as noted above, conventional tracks as those shown were designed to receive two pairs of single glazed sashes. If it were necessary to proceed with redesigning of tracks 34 and 36, the spacing between the guide grooves in each pair could be different depending upon the construction of the sash frames of frames 22 and 24 although there is no apparent reason to so modify the design of the tracks. In any event, the spacing should remain sufficiently long in order to properly seat and guide the sashes as it will be described hereinafter in greater detail, and also in order to obtain sufficient thermal insulation due to the use of hollow extrusions for the construction of the sash frames.

Each of sashes 22 and 24 is made with a sealed double glazing unit 60 and 67 and of a sash frame 68 and 66 comprising four extruded members made of thermally insulating plastic materials such as, for example, polyvinyl chloride. These four extruded members are, in the case of fixed sash 22, sash sill 70, a sash head 71, a right sash jamb 72 and a meeting sash member 73. Each of these extruded members 70,71,72 and 73 comprises, on the side facing the inside of the sash frame, a wide groove adapted to receive and frame therein the sealed double glazing element 60, and appropriate means are used to retain these extruded components at their respective end. On the embodiment illustrated in FIG. 3, this fastening means comprises screw flutes 74 into which one may insert the threaded end of a metal screw in accordance with a well-known technique.

Slidable sash 24 comprises a sash frame constructed in the same manner. It comprises a sash sill 80, a sash head 81, a left (exterior) jamb 82 and a meeting sash member 83. A screw flute 84 is provided at an appropriate location inside the hollow portions of sash sill 80 and sash head 81, one only of them being visible in FIG. 3.

The extruded members forming the sash head and the sash sill of each sash, that is to say, the extrusion for members 70, 71, 80 and 81 are hollow and present, on the side opposite the glazing, two guiding legs parallel and spaced apart by a distance corresponding to the distance between the guide grooves in any pair thereof. Thus sash sill 80 of movable sash 24 comprises two guiding legs 85 and 86 (see FIG. 3), sash sill 70 of fixed sash 22 is constructed in the same manner, and sash head 71 of fixed sash 22 comprises two guiding legs 75 and 76 while sash head 81 of slidable sash 24 is also constructed in an analogue if not identical fashion. In each case one uses a hollow extruded member as seen at reference numeral 77 for the head sash 71 and at reference numeral 87 for sill sash 80 of the slidable sash 24. One may also provide a hollow box-like projection 79 and 89 in each outer edge of the meeting sash members 73 and 83.

A system of flanges and weather strips assures weatherproofing of the window, in the close position, where the two sashes 22 and 24 meet one another at their meeting sash members 73 and 83. In FIG. 2, an overlapping flange 91 of meeting sash member 83 is disposed behind the corresponding overlapping flanges 92 of meeting sash member 83 and weather strips 93 and 94 are respectively secured to meeting sash members 73 and 83. Other weather strips are obviously required along the three other sides of the slidable sash. Such weather strips are visible in the lower half of FIG. 3 on either side of the two guide grooves 61 and 62 at reference numerals 95, 96, 97 and 98 while in the case of head 14, track 34 comprises, in each of its guide grooves 51 and 52 an other weather stip 100, 101 respectively. When folded flanges are already provided along receiving grooves as in vertical tracks 30 and 32 of frame 12, as shown in FIG. 2, these folded flanges play the same role as that of weather strips as mentioned above. Thus, vertical track 30 comprises on each side of receiving grooves 40 and 41 folded flanges 102, 103, 104 and 105 and this is also the case with respect to track 32 on left jamb 20 as shown at reference numerals 106 to 109. In practice, a sliding window having two sashes each with a sealed double glazing element as shown in the drawings of the present application, provides an excellent degree of weather-proofing against infiltration of air especially if the fixed sash 22 is retained in place against the corresponding jamb 30 by means of fasteners 110, for example, a wood screw provided in the bottom of a hollow projection 112 on the inner side of extruded member 70 of the sash frame. To permit access to fasteners 110, one provides small holes in the wall 114, which may be covered with a removable stopper (not shown). The sash jambs 72 and 82 of sashes 22 and 24 are of similar construction. In each case one provides two guiding projections 120 and 121, 122 and 123 respectively which enter deeply against folded flanges 102 to 109 in receiving grooves 40 to 43 respectively. Hollow extension 112 of sash jamb 72 and hollow extension 125 of sash jamb 82 constitute an efficient thermal barrier between the interior and the exterior conditions of window 10 and the effect of these hollow extensions combines with that of the air spaces 129 and 131 found between the guiding projections 120 to 123 for each of sashes 22 and 24.

Referring to FIG. 3, each of the sashes, be it the movable sash 24 or the fixed sash 22, has its guiding legs, on the sash head and the sash sill in vertical alignment with the two glass panes of the sash. The glass panes may for convenience be described as lying in two imaginary parallel reference planes in which lie the pairs of guiding legs on the sash head and the sash sill. Referring to FIG. 2, the guiding projection 120 of the fixed sash 22 and the guiding projection 105 of the movable sash 24 lie, in a respective imaginary reference plane, materialized by a glass pane. The offset guiding projections, 121 and 122 do not lie in any of the imaginary reference planes.

In the case of relatively tall sashes, of the order of 4 feet or more, the friction upon displacement of slidable sash 24 upon sill track 36 of sill 16 must be controlled and limited to an acceptable maximum level pursuant to commercially acceptable requirements in the areas of relatively cold climates during winter time. According to this invention, a runner 130 made of an appropriate anti-friction material is provided between guiding legs 85 and 86 of the sash sill 70, which anti-friction runner 130 applies the weight of slidable sash 24 onto the horizontal bearing surface 132 located between guide grooves 61 and 62 of sill track 36. Thus, lower guiding legs 85 and 86 are displaced upwardly from the bottom of guide grooves 61 and 62 and accordingly all excessive friction between slidable sash 24 and sill track 36 is eliminated. Runner 130 is a relatively thin and elongated strip whose transverse cross-section is constant essentially rectangular. Although a single runner 130 of sufficient length may be used, in practice it is sufficient to provide one short strip 130 toward each end of the bottom edge of slidable sash 24, these strips being approximately 10 centimeters long each. Their thickness is not critical, the important feature being freeing the lower guiding legs 85 and 86 to prevent their friction in the bottom of guide grooves 61 and 62 of sill track 36. A thickness of the order of 1.5 to 2 millimeters is sufficient. In order to retain these two strips 130 in place in the space comprised between lower guiding legs 85 and 86, it is convenient to use an appropriate adhesive, avoiding all spilling. In the case of sill track 36, made of polyvinyl chloride, the use of runners 130 made of a high density plastic such as that sold under the trade mark TEFLON or under the trade mark UHFW provides excellent results. In the case of windows whose sashes reach a height of 2 meters, this construction allows one to maintain the maximum opening resistance of the slidable sash to a level below 5 kilograms once the sliding sash is no longer in contact with vertical track 32.

Figure 4:
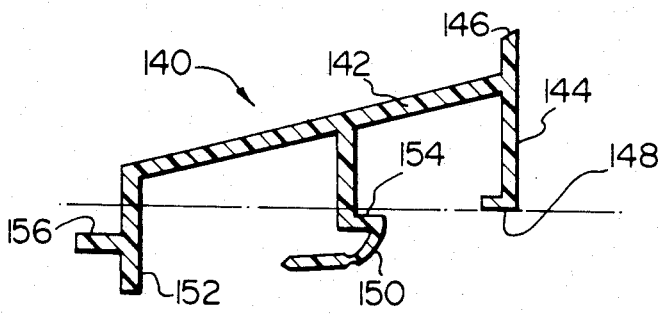
FIG. 4 is a cross-sectional view of an extrusion used as a waterproofing cover for the sliding window described in the other figures of drawings.

In certain cases, water and air infiltration underneath slidable sash 24 remains a problem due to the use of a single sash without storm window. In this regard, the sliding window according to the present invention may comprise also a waterproofing cover 140 such as that shown in FIG. 3 and whose details of construction appear in FIG. 4. This waterproofing cover 140 comprises a main sloping surface 142 starting from an essentially vertical wall 144 whose apex 146 fits into the lower, inwardly offset portion 147 of extruded element 80 of slidable sash 24. Apex 146 is also inclined toward the outside in order to force water outwardly toward main sloping surface 142. Foot 148 of vertical wall 144 bears against the upper surface of sill track 36 while the other two legs 150 and 152 enter into guide grooves 63 and 64 of sill track 36 as shown in FIG. 3. Shoulder 154 of the lower rounded portion of the central leg 150 takes support from underneath the projecting part of groove 63 and it cooperates with projection 156 of the exterior leg 152 to retain the waterproofing cover 140 in position on sill track 36. Waterproofing cover 140 may be an extrusion made of polyvinyl chloride or any other appropriate thermal plastic material, and one may even use a light metal such as aluminum.

Referring now to FIG. 2, the illustrated embodiment shows a latch 160 to retain slidable sash 24 in the fully closed position. This locking device is provided with a pivotal hook secured to left jamb 20 of frame 12, and latch 160 retains the handle 162 provided on the inner surface of extruded member 82 of the sash frame of slidable sash 24.

In order to ensure proper draining of the window end, it is preferable to provide drain holes 170, 172, 174 and 176 in the bottom of the various guide grooves of sill track 36 which sits upon the inclined surface of sill 16, and for better waterproofing it is preferable to use, over sill 16, a plastic clading 180 extending from end to end over sill 16 under sill track 36.

I claim:

1. An improved thermally insulating sliding sash unit usable as a replacement for inner and outer single glazed panes in a double sliding window frame, which frame extends generally parallel to a basic reference plane, said frame having a head, a sill and two jamb members, one on each side of said frame, said head and said sill having, respectively, a head track and a sill track with two similar pairs of guide grooves in each track, there being an inner sash edge receiving groove in each jamb member for receiving one of the inner single glazed panes when closed, and an outer sash edge receiving groove for receiving one of the outer single glazed panes when closed, said head and sill tracks being fixed relative to said frame against movement in a direction normal to said basic reference plane, said improved sash unit comprising:

a sealed multiple glazing element of rectangular configuration and a sash frame mounted to said glazing element, said sash frame comprising four extruded members of thermally insulating plastic material, namely a sash head, a sash sill, a sash jamb and a meeting sash member, said sash frame being held in a rectangular configuration and bordering said glazing element on all four sides thereof, (a) each of said sash head and said sash sill being hollow and having, on the side receiving said glazing element, a glazing element groove, and on an opposite side a pair of parallel guiding legs, namely a first guiding leg and a second guiding leg, said guiding legs being shaped and spaced to engage in either one of said two pairs of guide grooves of said head track and of said sill track, (b) said sash jamb having, on the side receiving said glazing element, a glazing element groove, and on an opposite side, a pair of spaced apart guiding projections, namely a first guiding projection and a second guiding projection, said guiding projections being shaped and spaced to fit into both of said inner and outer sash edge receiving grooves of either jamb member when said improved sash unit is in its closed position within said double sliding window frame, (c) the first guiding leg of said sash head, the first guiding leg of said sash sill and the first guiding projection lying in a first reference plane, the second guiding leg of said sash head and the second guiding leg of said sash sill lying in a second reference plane, the second guiding projection being offset with respect to said second reference plane, in a direction away from said first reference plane, said sash jamb also comprising a lateral extension for mounting said offset guiding projection to said sash jamb, the distance between said pair of guiding projections being greater than the distance between said parallel guiding legs.

2. An improved sash unit as defined in claim 1 wherein said lateral extension is a triangular hollow structure integrally formed with said sash jamb.

3. An improved sash unit as defined in claim 1 wherein said meeting sash member has a glazing element groove on one side, an integral hollow box-like projection on an opposite side and laterally extending weatherproofing means.

4. An improved sash unit as defined in claim 1 wherein said sash sill comprises in the space between its guiding legs, a bearing surface for receiving one or more strip-like runners made of suitable anti-friction material such as TEFLON plastic material or comparable material.

5. An improved sash unit as defined in claim 1 wherein said glazing element of each sash is a sealed double glazed element.

6. A sliding window comprising:

a frame, said frame extending generally parallel to a basic reference plane, a track means on said frame defining an opening of said window, a set of at least two removable sashes one of which being slidable, said sashes closing said opening when said slidable sash is in the closed position, said frame comprising a head, a sill and two jambs, one on each side of said frame, said track means comprising a head track on said head, and a still track on said sill, said head track and said sill track being fixed relative to said frame against movement in a direction normal to said basic reference plane, each of said head and sill tracks defining an outer pair of guide grooves and an inner pair of guide grooves, said outer pair of head guide grooves being similar to the inner pair of head guide grooves and said outer pair of sill guides grooves being similar to the inner pair of sill guide grooves, and said jambs each having an inner sash edge receiving groove and an outer sash edge receiving groove, said pairs of head and sill guide grooves and said inner and outer sash edge receiving grooves being arranged and co-related in such a manner as to receive inner and outer sets of single glazed panes used in conventional double sliding window construction, said set of sashes being thermally insulating and designed to replace said inner and outer sets of single glazed panes, (a) each of said sashes comprising a sealed multiple glazing element of rectangular configuration and a sash frame mounted to the edges of said multiple glazing element, said sash frame comprising four extruded members of thermally insulating plastic material, namely a sash head, a sash sill, a sash jamb and a meeting sash member, (b) each said sash frame being held in a rectangular configuration and bordering said glazing element on all four sides thereof, (c) each of said sash head and said sash sill being hollow and having, on the side receiving said glazing element, a glazing element groove, and on an opposite side a pair of parallel guiding legs, namely a first guiding leg and a second guiding legs, said guiding legs being shaped and spaced to engage in either one of said two pairs of guide grooves of said head track and of said sill track, (d) said sash jamb having, on the side receiving said glazing element, a glazing element groove, and on an opposite side, a pair of spaced apart guiding projections, namely a first guiding projection and a second guiding projection, said guiding projections being shaped and spaced to fit into both of said inner and outer sash edge receiving grooves of either jamb member when said slidable sash is in its closed position within said frame, (e) the first guiding leg of said sash head, the first guiding leg of said sash sill and the first guiding projection lying in a first reference plane, the second guiding leg of said sash head and the second guiding leg of said sash sill lying in a second reference plane, the second guiding projection being offset with respect to said second reference plane, in a direction away from said first reference plane, said sash jamb also comprising a lateral extension for mounting said offset guiding projection to said sash jamb, the distance between said guiding projections being greater than the distance between said guiding legs.

7. A sliding window as defined in claim 6 wherein said lateral extension is a triangular hollow structure integrally formed with said sash jamb.

8. A sliding window as defined in claim 7 wherein said meeting sash member has a glazing element groove on one side, an integral hollow box-like projection on an opposite side and laterally extending weatherproofing means.

9. A sliding window as defined in claim 6 wherein said sash sill comprises in the space between its guiding legs, a bearing surface for receiving one or more strip-like runners made of suitable anti-friction material such as TEFLON plastic material or comparable material.

10. A sliding window as defined in claim 6 wherein said glazing element of each sash is a sealed double glazed element.

11. A sliding window as defined in claim 6 wherein said set of sashes includes a fixed sash mounted in said frame on the outer pair of guide grooves of said head and sill tracks, said sliding window, additionally comprising a removable waterproofing cover disposed horizontally over and covering all of a portion of said outer pair of guide grooves which is exposed to the weather elements when said fixed sash is in place in said frame.

12. A sliding window as defined in claim 11 wherein said removable waterproofing cover is an extrusion of plastic material having a main upper sloping surface extending outwardly and downwardly, an inner vertical wall supporting an innermost edge of said main upper sloping surface and being disposed next to an outermost region of the sash sill of said slidable sash when same is in the closed position and a pair of downwardly projecting groove engaging legs depending from an underside of said main sloping surface, said groove engaging legs having means for retaining said removable waterproofing cover to said sill track.

13. In combination, a sliding window having a frame with horizontally extending head and sill tracks, at least two sashes mounted in said tracks, one sash being mounted in a plane located inward relative to a plane of the other sash, and a waterproofing cover of plastic material removably mountable in said sill tracks beside the said other sash, said cover comprising:

a main sloping surface, having an inner edge and an outer edge, an inner vertical wall supporting the inner edge of said sloping surface, and two spaced apart downwardly projecting groove engaging legs depending from an underside of said main sloping surface and at least one of said legs provided with means for resiliently retaining said waterproofing cover to a groove of the sill track of said sliding window.

14. A waterproofing cover as defined in claim 13, said inner vertical wall projecting upwardly beyond said main sloping surface and having an outwardly and downwardly slanted apex.

15. An improved thermally insulating sliding sash unit usable as a replacement for inner and outer single glazed panes in a double sliding window frame, which frame extends generally parallel to a reference plane, said frame having a head, a sill and two jamb members, one on each side of said frame, said head and said sill having, respectively, a head track and a sill track with two similar pairs of guide grooves in each track, there being an inner sash edge receiving groove in each jamb member for receiving one of the inner single glazed panes when closed, and an outer sash edge receiving groove for receiving one of the outer single glazed panes when closed, said head and sill tracks being fixed against movement relative to said frame in a direction normal to said reference plane, said improved sash unit comprising:

a sealed multiple glazing element of rectangular configuration and a sash frame mounted to said glazing element, said sash frame comprising four extruded members of thermally insulating plastic material, namely a sash head, a sash sill, a sash jamb and a meeting sash member, said sash frame being held in a rectangular configuration and bordering said glazing element on all four sides thereof, (a) each of said sash head and said sash sill being hollow and having, on the side receiving said glazing element, a glazing element groove, and on an opposite side a pair of parallel guiding legs which are shaped and spaced to engage in either one of said two pairs of guide grooves of said head track and of said sill track, (b) said sash jamb having, on the side receiving said glazing element, a glazing element groove, and on an opposite side, a pair of spaced apart guiding projections which are shaped and spaced to fit into both of said inner and outer sash edge receiving grooves of either jamb member when said improved sash unit is in its closed position within said double sliding window frame, one of said guiding projections being offset with respect to said glazing element, (c) said sash jamb also comprising a lateral extension for mounting said offset guiding projection to said sash jamb, the distance between said pair of guiding projections being greater than the distance between said parallel guiding legs, said lateral extension being a triangular hollow structure integrally formed with said sash jamb.

16. A sliding window comprising:

a frame, said frame extending generally parallel to a reference plane, a track means on said frame defining an opening of said window, a set of at least two removable sashes one of which being slidable, said sashes closing said opening when said slidable sash is in the closed position, said frame comprising a head, a sill and two jambs, one on each side of said frame, said track means comprising a head track on said head, and a sill track on said sill, said head track and said sill track being fixed relative to said frame against movement in a direction normal to said reference plane, each of said head and sill tracks defining an outer pair of guide grooves and an inner pair of guide grooves, said outer pair of head guide grooves being similar to the inner pair of head guide grooves and said outer pair of sill guide grooves being similar to the inner pair of sill guide grooves, and said jambs each having an inner sash edge receiving groove and an outer sash edge receiving groove, said pairs of head and sill guide grooves and said inner and outer sash edge receiving grooves being arranged and co-related in such a manner as to receive inner and outer sets of single glazed panes used in conventional double sliding window construction, said set of sashes being thermally insulating and designed to replace said inner and outer sets of single glazed panes, (a) each of said sashes comprising a sealed multiple glazing element of rectangular configuration and a sash frame mounted to the edges of said multiple glazing element, said sash frame comprising four extruded members of thermally insulating plastic material, namely a sash head, a sash sill, a sash jamb and a meeting sash member, (b) each said sash frame being held in a rectangular configuration and bordering said glazing element on all four sides thereof, (c) each of said sash head and said sash sill being hollow and having, on the side receiving said glazing element, a glazing element groove, and on an opposite side a pair of parallel guiding legs which are shaped and spaced to engage in either one of said two pairs of guide grooves of said head track and of said sill track, (d) said sash jamb having, on the side receiving said glazing element, a glazing element groove, and on an opposite side, a pair of spaced apart guiding projections which are shaped and spaced to fit into both of said inner and outer sash edge receiving grooves of either jamb member when said slidable sash is in its closed position within said frame, one of said guiding projections being offset with respect to said glazing element, (e) said sash jamb also comprising a lateral extension for mounting said offset guiding projection to said sash jamb, the distance between said guiding projections being greater than the distance between said guiding legs, said set of sashes including a fixed sash mounted in said frame on the outer pair of guide grooves of said head and sill tracks, said sliding window additionally comprising a removable waterproofing cover disposed horizontally over and covering all of a portion of said outer pair of guide grooves which is exposed to the weather elements when said fixed sash is in place in said frame.

17. A sliding window as defined in claim 16 wherein said removable waterproofing cover is an extrusion of plastic material having a main upper sloping surface extending outwardly and downwardly, an inner vertical wall supporting an innermost edge of said main upper sloping surface and being disposed next to an outermost region of the sash sill of said slidable sash when same is in the closed position and a pair of downwardly projecting groove engaging legs depending from an underside of said main sloping surface, said groove engaging legs having means for retaining said removable waterproofing cover to said sill track.

* * * * *